US006775502B1

(12) United States Patent
Domoto et al.

(10) Patent No.: US 6,775,502 B1
(45) Date of Patent: Aug. 10, 2004

(54) SYSTEM AND METHOD FOR HIGH SOLIDS IMAGE CONDITIONING OF LIQUID INK IMAGES UTILIZING A SOURCE OF HIGH FLUID PRESSURE TO CONFIGURED TO EMIT A JET OF FLUID

(75) Inventors: Gerald A. Domoto, Briarcliff Manor, NY (US); Donald M. Bott, Rochester, NY (US); Shu Chang, Pittsford, NY (US); Palghat S. Ramesh, Pittsford, NY (US); Fa-Gung Fan, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 22 days.

(21) Appl. No.: 10/373,478

(22) Filed: Feb. 24, 2003

(51) Int. Cl.[7] ..... G03G 15/10
(52) U.S. Cl. ..... 399/249
(58) Field of Search ..... 399/249, 237

(56) References Cited

U.S. PATENT DOCUMENTS 4,264,912 A * 4/1981 Coburn et al. ..... 399/249
5,666,617 A 9/1997 Goodman et al.
5,978,630 A 11/1999 Chang et al.
6,006,059 A 12/1999 Till et al.

* cited by examiner

*Primary Examiner*—Quana Grainger
(74) *Attorney, Agent, or Firm*—Maginot, Moore & Beck

(57) ABSTRACT

A system includes at least one movable image bearing member transporting a latent image in an electrophotographic printing system. A developer station associated with the at least one image bearing member deposits a developed image on the latent image. The developed image includes toner particles and carrier liquid. A transfer station associated with the at least one image bearing member transfers the developed image to a receiving medium. A liquid removal station disposed between the developer station and the transfer station includes a source of high fluid pressure emitting an open-air jet of fluid for directly and/or indirectly removing at least a portion of the carrier liquid from the developed image.

15 Claims, 11 Drawing Sheets

SYSTEM AND METHOD FOR HIGH SOLIDS IMAGE CONDITIONING OF LIQUID INK IMAGES UTILIZING A SOURCE OF HIGH FLUID PRESSURE TO CONFIGURED TO EMIT A JET OF FLUID

FIELD OF THE INVENTION

The subject invention relates generally to high solids image conditioning of liquid ink images, and in particular, to high solids image conditioning of liquid ink images by removal of liquid.

BACKGROUND OF THE INVENTION

Generally, the process of electrophotographic copying is initiated by illuminating an original document with a light source to generate a light image of the original document. A substantially uniformly charged photoreceptive member is exposed with the light image to discharge the surface areas of the photoreceptive member that correspond to non-image areas in the original document while maintaining the charge in image areas. This selective discharging scheme produces an electrostatic latent image of the original document on the surface of the photoreceptive member. This latent image is subsequently developed into a visible image by a process in which developer material is deposited onto the surface of the photoreceptive member. Typically, this developer material comprises carrier granules having toner particles that electrostatically adhere to the charged areas of the latent image to form a powder toner image on the photoreceptive member.

Alternatively, liquid developer materials that include liquid carrier material in which toner particles are dispersed may be used. When liquid developer materials are used, the developer material is applied to the latent image with the toner particles being attracted toward the image areas to form a liquid image. Regardless of the type of developer material employed, the toner particles of the developed image are subsequently transferred from the photoreceptive member to a copy sheet, either directly or by way of an intermediate transfer member. Once on the copy sheet, the image may be permanently affixed to provide a "hard copy" reproduction of the original document or file. The photoreceptive member is then cleaned to remove any charge and/or residual developer material from its surface in preparation for subsequent imaging cycles.

The above-described electrophotographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as DAD, or "write black" systems, in contradistinction to the light lens generated image systems which develop toner on the charged areas, known as CAD, or "write white" systems. The subject invention applies to both such systems.

When using liquid developer materials or toners, the liquid carrier medium needs to be removed from the photoconductive surface after the toner has been applied so the liquid carrier is not transferred from the photoreceptor to the paper or to the intermediate medium and then to the paper during image transfer. Removing the liquid carrier also allows it to be recovered for recycling and reuse in the developer system. This provides additional cost savings in terms of printing supplies and helps eliminate environmental and health concerns that result from the disposal of excess liquid carrier medium.

One known method of removing excess carrier fluid from a developed image requires placing a blotter roll in rotatable contact with the image while it resides on the photoreceptor or intermediate substrate. The blotter roll is typically made from an absorbent material, which allows the excess carrier fluid to be drawn from the surface of the photoreceptor or intermediate substrate and into the contacting roll. The fluid is then removed from the roll via a vacuum applied to the interior cavity of the roll. Removal of carrier fluid from the surface of the image results in an increase in solid particle content, increasing the efficiency of the transfer of the image from the photoreceptor to the intermediate substrate or from the intermediate substrate to permanent media. However, vacuum alone has a limited ability to remove the carrier liquid from the blotter roll.

The solid content of the toner particles can be increased to 40% or higher if a High Solids Image Conditioning (HSIC) unit is used. One form of a HSIC unit includes a high contact pressure blotter roll or squeegee roll that presses against the photoreceptor or intermediate transfer belt (ITB) and squeezes the liquid carrier out of the photoreceptor or ITB via mechanical compaction. A problem is that there is a limit to how much liquid carrier may be squeezed out of the photoreceptor or ITB by applying high pressure to increase the solid particle content. Squeegee roll methods have difficulty in removing the liquid from the interstices of a highly packed particle layer primarily because air does not flow in the narrow liquid- and solid-filled nip between the blotter roll and the compacting roll that pushes the image carrier into engagement with the blotter roll.

FIG. 1 is a plot of the solids content percentage of a developed image versus nip pressure in a known squeegee roll image conditioning method. As indicated by the trend of the data in FIG. 1, a solids content fraction above approximately 50% cannot be attained. Pressures as high as 100–200 psi in the nip may be required to increase the toner solids content to 40% solid particles by weight in the image. Such high nip pressure creates a drag on the photoreceptor belt or ITB and motion quality control issues.

Another known form of a HSIC unit for removing excess carrier fluid from a developed image evaporates the carrier liquid directly from the image. Such an evaporating HSIC requires heat management on the substrate and/or the ITB, a high volume of air flow, and high power consumption. In transfuse systems, heat management is difficult to implement on the thick conformable members required for good media latitude. Another problem is that liquid carriers that may be evaporated may present environmental issues.

The most efficient conditioning of an image to increase the percentage of solids content obviously requires preventing the solid toner particles from leaving the image while removing the carrier liquid. Successful image conditioning also requires electrostatic forces to hold or stabilize the toner particles in order to increase the clarity and resolution of the toner image. In addition, the carrier liquid removal device must also remain clean and free of toner particles so as to prevent it from thereafter contaminating a subsequent image with embedded toner particles.

Various techniques and devices have been devised for conditioning the liquid developer image by using blotter rolls or rollers to remove carrier liquid from the image as discussed above. Using one method, the developed image containing approximately 8% to 10% solid particles is first subjected to treatment by a Low Solids Image Conditioner (LSIC) which increases the percentage of solids to approximately 14% to 20%, while increasing the stability of the image, and reducing the thickness of the background fluid. High Solids Image Conditioning (HSIC) is then applied in order to increase the solid particle content to approximately 40%–45%, enabling the image to be transferred and fixed to a fmal substrate, without removing solid particles along with the carrier fluid.

The application of high contact pressure to the image, as described earlier, unfortunately results in the offset of a substantial amount of the toner particles to the blotter surface when the input image reaches higher toner concentrations. Thus, it is advantageous to devise a way in which the solid particle content of an image developed using a liquid material may be substantially increased without requiring a high contact pressure to be applied to the surface of the image. The application of high contact pressure may also result in a mechanical drag on the movement of the photoreceptor.

Accordingly, there is a need for a method of High Solids Image Conditioning (HSIC) that does not rely on the application of high contact pressure to the image-bearing member (IBM) to remove liquid carrier from the image. There is also a need for a method of High Solids Image Conditioning (HSIC) that achieves a higher toner solids content percentage without mechanically dragging the IBM movement. Further, there is a need for a method of High Solids Image Conditioning (HSIC) that does not require carrier fluid evaporation, high power consumption or the use of liquid carriers that present environmental issues.

SUMMARY OF THE INVENTION

The above needs, as well as others, are fulfilled by providing a system having an air knife to directly or indirectly remove liquid carrier from an IBM. The air knife may be applied directly to the IBM to blow carrier liquid out of the IBM into a container or blotting roll. Alternatively, a blotting belt may be pressed against the IBM in order to absorb carrier liquid and an air knife may be used to blow carrier liquid out of the blotting belt to restore its absorption properties. Thus, the air knife improves the effectiveness of the blotting belt in removing liquid carrier from the image transporter without requiring nip pressures that distort the image.

In embodiments of the invention, an arrangement includes at least one movable image bearing member transporting a latent image in an electrophotographic printing system. A developer station associated with the at least one image bearing member deposits a developed image on the latent image. The developed image includes toner particles and carrier liquid. A transfer station associated with the at least one image bearing member transfers the developed image to a receiving medium. A liquid removal station disposed between the developer station and the transfer station includes a source of high fluid pressure emitting a jet of fluid that removes at least a portion of the carrier liquid from the developed image. The fluid jet may remove the carrier liquid directly from the image bearing member or it may indirectly remove carrier liquid from the image bearing member by blowing carrier liquid from a blotting belt or the like.

The method of the present invention includes transporting a latent image containing liquid carrier and toner particles on a porous substrate and directing a jet of fluid against the latent image to blow liquid carrier from the porous substrate. The method may also include providing a vacuum proximate to a surface of the porous substrate to remove liquid carrier blown from the substrate. In an alternative method of the present invention, the method includes applying fluid pressure against a portion of a blotting belt to remove liquid carrier from the blotting belt and contacting a latent image being carried by a porous substrate with the portion of the blotting belt from which the fluid pressure removed liquid carrier. This alternative method may further include cleaning the blotting belt with fluid to remove toner particles from the blotting belt.

The systems and methods of the present invention provide high toner solids content percentage without requiring heat for carrier liquid evaporation or the application of high pressure to the IBM to squeeze carrier liquid out of the belt. Thus, the removal of carrier liquid from the image can be performed more efficiently with less effect upon the image quality.

The above discussed features and advantages, as well as others, may be readily ascertained by those of ordinary skill in the art by reference to the following detailed description and accompanying drawings.

DETAILED DESCRIPTION

Figure 1:
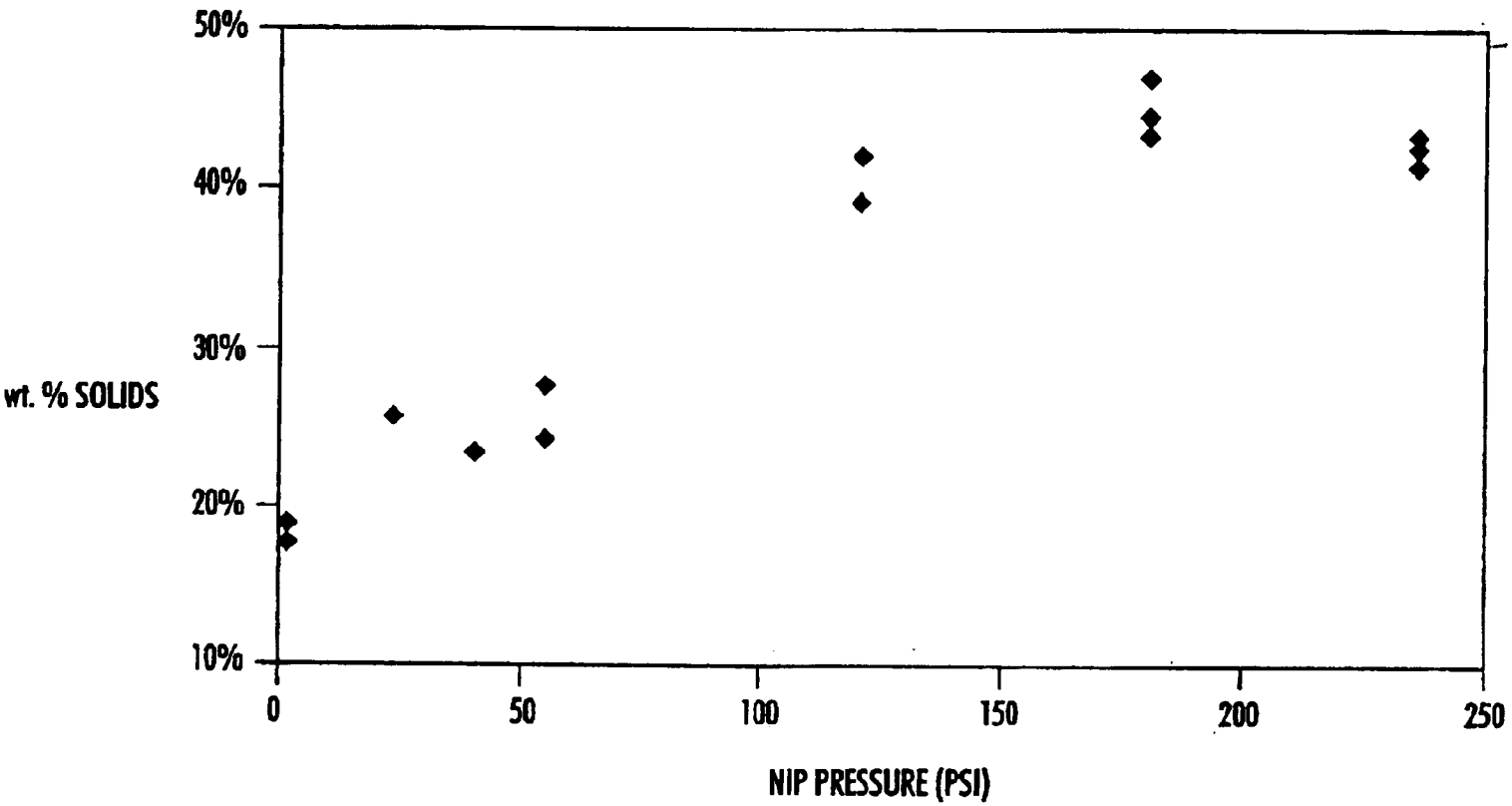
FIG. 1 PRIOR ART
FIG. 1 shows a plot of the solids content percentage of a developed image versus nip pressure in a known squeegee roll image conditioning method.
Figure 2:
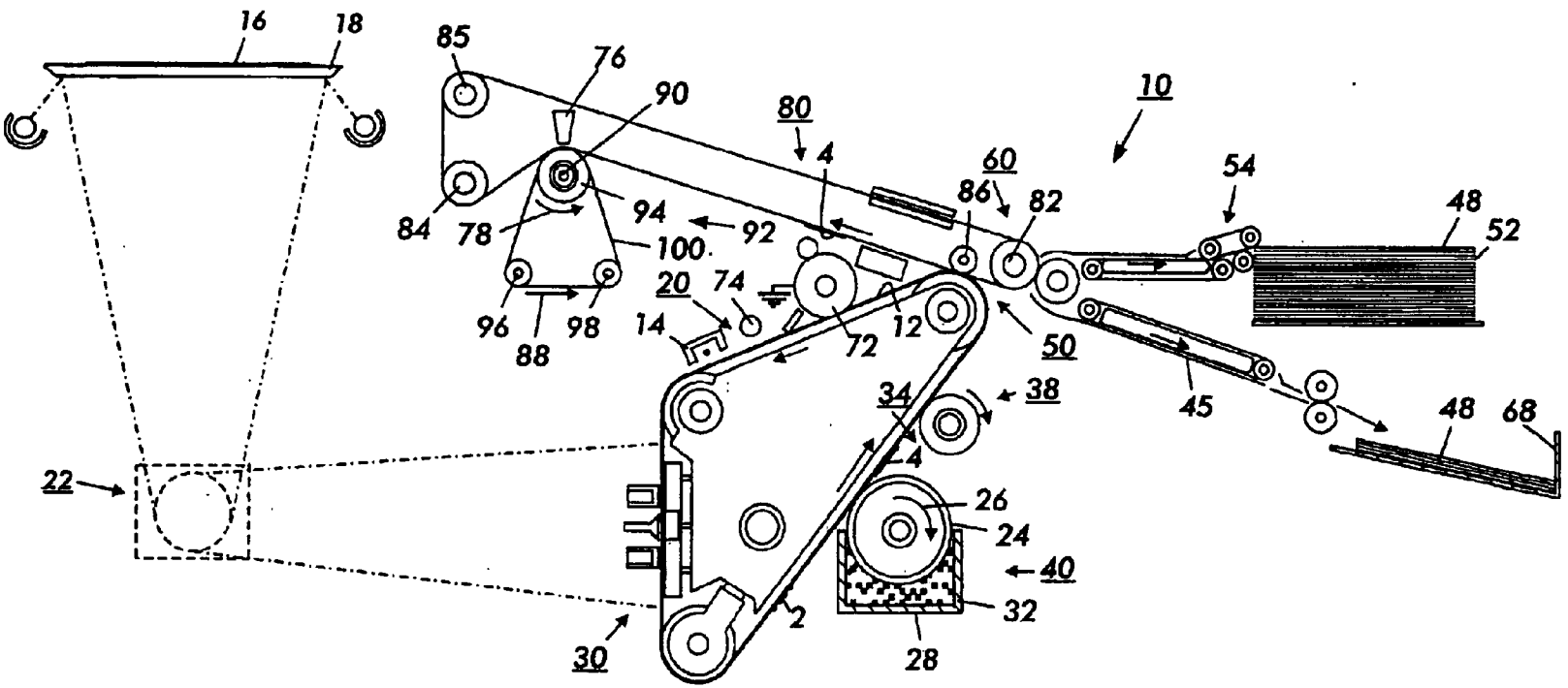
FIG. 2 shows a schematic view of an exemplary electrophotographic machine that includes an arrangement according to embodiments of the subject invention.

Referring now to the drawings where the showings are for the purpose of describing exemplary embodiments of the invention and not for limiting the same, in FIG. 2, a reproduction or printing machine 10 employs a belt 12 having a photoreceptive surface deposited on a conductive substrate. Initially, belt 12 passes through a charging station 20. At the charging station 20, a corona generating device 14 charges the photoreceptive surface of belt 12 to a relatively high, substantially uniform potential.

Once the photoreceptive surface of belt 12 is charged, the charged portion advances to an exposure station 30. An original document 16 which is located upon a transparent support platen 18 is illuminated by an illumination assembly, indicated generally by the reference numeral 22, to generate a light image of document 16. The image rays of the light image correspond to the document information areas and are projected by an optical system of assembly 22 onto the charged portion of the photoconductive surface. The light image dissipates the charge in selected areas to form an electrostatic latent image 2 on the photoreceptive surface that corresponds to the original document informational areas.

Printing machine 10 is disclosed herein as including an analog imaging system. However, it is to be understood that the present invention can also be used in conjunction with a digital imaging system.

After electrostatic latent image 2 has been formed, belt 12 advances electrostatic latent image 2 to a development station 40. At the development station 40, a roller 24, rotating in the direction of arrow 26, brings liquid developer material 28, which includes toner particles dispersed substantially throughout a carrier fluid, from the chamber of housing 32 to a development zone 34. The toner particles pass by electrophoresis to the electrostatic latent image 2. The charge of the toner particles may be opposite in polarity to the charge on the photoreceptive surface when a CAD system, or "write white" system, is used. Thus, the toner particles are attracted to the charged areas of the latent image. Alternatively, the charge of the toner particles may be identical in polarity to the charge on the photoreceptive surface in the case of a DAD system, or "write black" system. In a DAD system, toner is repelled from the charged areas and developed on the discharged areas.

Development station 40 includes a Low Solids Image Conditioner (LSIC) 38. The LSIC 38 encounters developed image 4 on belt 12 and conditions developed image 4 by removing and reducing the liquid content of the developed image 4, while inhibiting and preventing the removal of solid toner particles. LSIC 38 also conditions the image by electrostatically compacting the toner particles of the image. Thus, an increase in percent solids is achieved in the developed image, thereby improving the quality of the final image.

At transfer station 50, developed liquid image 4 is electrostatically transferred to an intermediate member in the form of a porous imaging belt indicated by a reference numeral 80. Intermediate belt 80 is entrained about spaced rollers 82, 84 and 85. A bias transfer roller 86 imposes the intermediate belt 80 against the belt 12 to assure image transfer to the intermediate belt 80.

Developed image 4 is brought in contact with a High Solid Image Conditioning (HSIC) unit 92, which further increases the solid particle content of a contacting image. HSIC unit 92 includes a source of high fluid pressure in the form of a high pressure air knife 76, a porous backing roll 94, spaced carrier rolls 96, 98, a porous cleaning belt 100, and a vacuum application system 90 of the present invention. HSIC unit 92 conditions developed image 4 on belt 80 by using air knife 76 to blow the liquid carrier out of developed image 4, thereby reducing its liquid content, while preventing toner particles from departing from the developed image 4. The backing roll 94 supports the belt against the open-air jet of air from the air knife 76. Wet developed image 4 is sandwiched between porous imaging belt 80 and porous cleaning belt 100. Cleaning belt 100 prevents toner particles from developed image 4 from contacting or contaminating backing roll 94.

Figure 3:
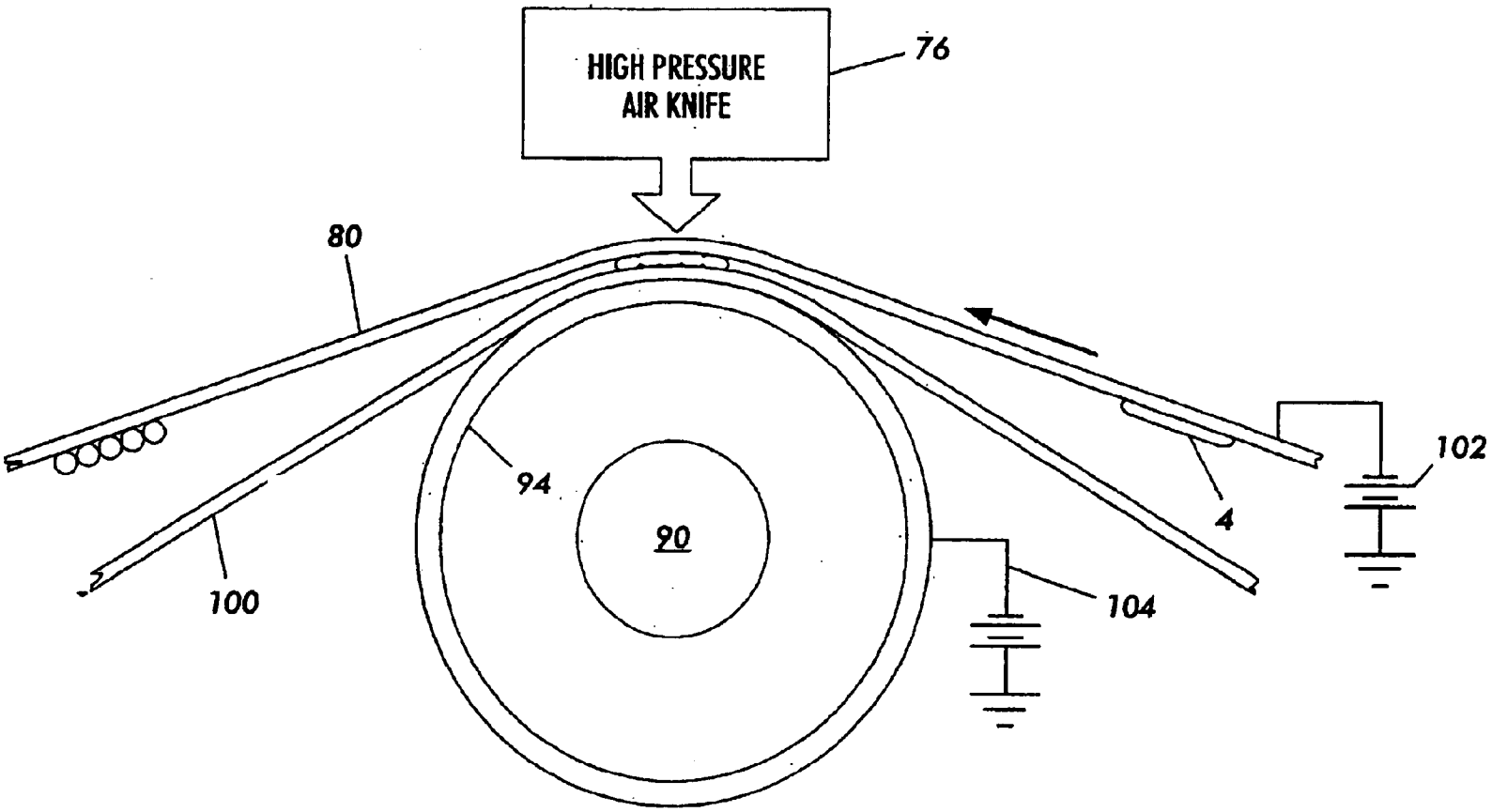
FIG. 3 shows an enlarged fragmentary view of the HSIC unit of the electrophotographic machine of FIG. 2.

Referring now to FIG. 3, another mechanism in addition to cleaning belt 100 prevents backing roll 94 from being contaminated with toner particles. More specifically, a voltage source in the form of a battery 102 applies a positive charge to both belt 80 and developed image 4. Another voltage source in the form of a battery 104 applies a positive charge to backing roll 94. Thus, the positively charged toner particles in developed image 4 are repelled by the positively charged backing roll 94, thereby further preventing toner particles from developed image 4 from contacting or contaminating backing roll 94. Batteries 102 and 104 apply an electric field in the HSIC nip which produces electrostatic forces on charged toner particles to keep the particles on the porous imaging belt. A characteristic of the dielectric liquid carrier in the developed image 4 is that it does not retain a charge, and thus is not charged by battery 102.

Air knife 76 and vacuum application system 90 remove carrier fluid from the surface of developed image 4 and transport the carrier fluid out of reproduction machine 10 for recycling or for collection and removal. More specifically, belt 80, supported by backing roll 94 on the outside surface of belt 80, transports developed image 4 past HSIC unit 92. Air knife 76 emits a jet of fluid, such as air, directly onto belt 80 with developed image 4 directly across from backing roll 94, thereby causing carrier fluid to be blown out of belt 80 and image 4, through cleaning belt 100, and into backing roll 94. Since the carrier fluid does not retain a charge, the carrier fluid is not electrostatically repelled by the charged backing roll 94, as are the charged toner particles within developed image 4. Vacuum application system 90 then draws carrier fluid from backing roll 94 and transports it away from the imaging system. It should be noted that while the apparatus shown in FIG. 2 shows only a single air knife 76, multiple air knives may be used in conjunction with a single belt or with the transfer of multiple images to an intermediate belt 80.

With continued reference to FIG. 3, vacuum application system 90 may be associated with backing roll 94 to facilitate continued removal of the carrier fluid from roll 94 to a container for recycling or for removal from the reproduction or printing machine. Although vacuum system 90 is schematically shown within backing roll 94 in FIGS. 2 and 3, vacuum system 90 may be a device separate from and external to backing roll 94. The vacuum applied by vacuum system 90 must be strong enough to draw fluid from backing roll 94 at a rate that will prevent backing roll 94 from becoming too saturated to allow it to continuously remove fluid from developed image 4. Roll 90 serves as an example of a vacuum system that may be associated with backing roll 94 to remove fluid therefrom. It is not intended to limit the invention to this type of vacuum applying device, as other liquid removal systems may also be successfully used.

In an alternative embodiment (not shown), the vacuum system includes a vacuum roller that may be brought adjacent to or in rotatable contact with the backing roll. The vacuum roller may be made from a fluid absorbing material and may have an interior vacuum cavity. A vacuum pump may be in fluid communication with the vacuum cavity to cause fluid in the backing roll to be drawn through the absorbing surface of the vacuum roller and into the vacuum cavity.

Referring again to FIG. 2, backing roll 94 rotates in the direction indicated by arrow 78 to thereby rotate cleaning belt 100 in the direction indicated by arrow 88. The rotation of belt 80 brings developed image 4 on belt 80 into contact with cleaning belt 100, and into position for conditioning by HSIC unit 92. More particularly, as developed image 4 comes into contact with cleaning belt 100, air knife 76 emits a jet of high pressure air to blow or remove the carrier liquid out of belt 80 and developed image 4. The carrier liquid is blown through and from porous cleaning belt 100 and is absorbed by porous backing roll 94.

The absorbed liquid may then be drawn from the surface of backing roll 94 by the negative pressure being applied by vacuum system 90. After vacuum system 90 removes fluid from backing roll 94, the fluid is transported out of the reproduction machine for recycling or removal. Backing roll 94 continues to rotate past subsequent developed images 4. This provides for a continuous absorption of liquid from the surface of developed image 4 as backing roll 94 is discharged of excess liquid due to its communication with vacuum system 90.

Belt 80 then advances developed image 4 to a transfer/fusing station 60. At transfer/fusing station 60, a copy sheet 48 of a receiving medium, such as paper, is advanced from a stack 52 by a sheet transport mechanism, indicated generally by the reference numeral 54. Developed image 4 on the surface of belt 80 is attracted to copy sheet 48, and is simultaneously heated and fused to the sheet by heat from roller 82, for example. After transfer, a conveyor belt 45 moves copy sheet 48 to discharge output tray 68.

After developed image 4 is transferred to intermediate belt 80, residual liquid developer material remains adhered to the photoconductive surface of belt 12. This material may be removed using any of several well known suitable cleaning devices 72, and any residual charge left on the photoconductive surface may be extinguished by flooding the photoreceptive surface with light from lamps 74.

Figure 4:
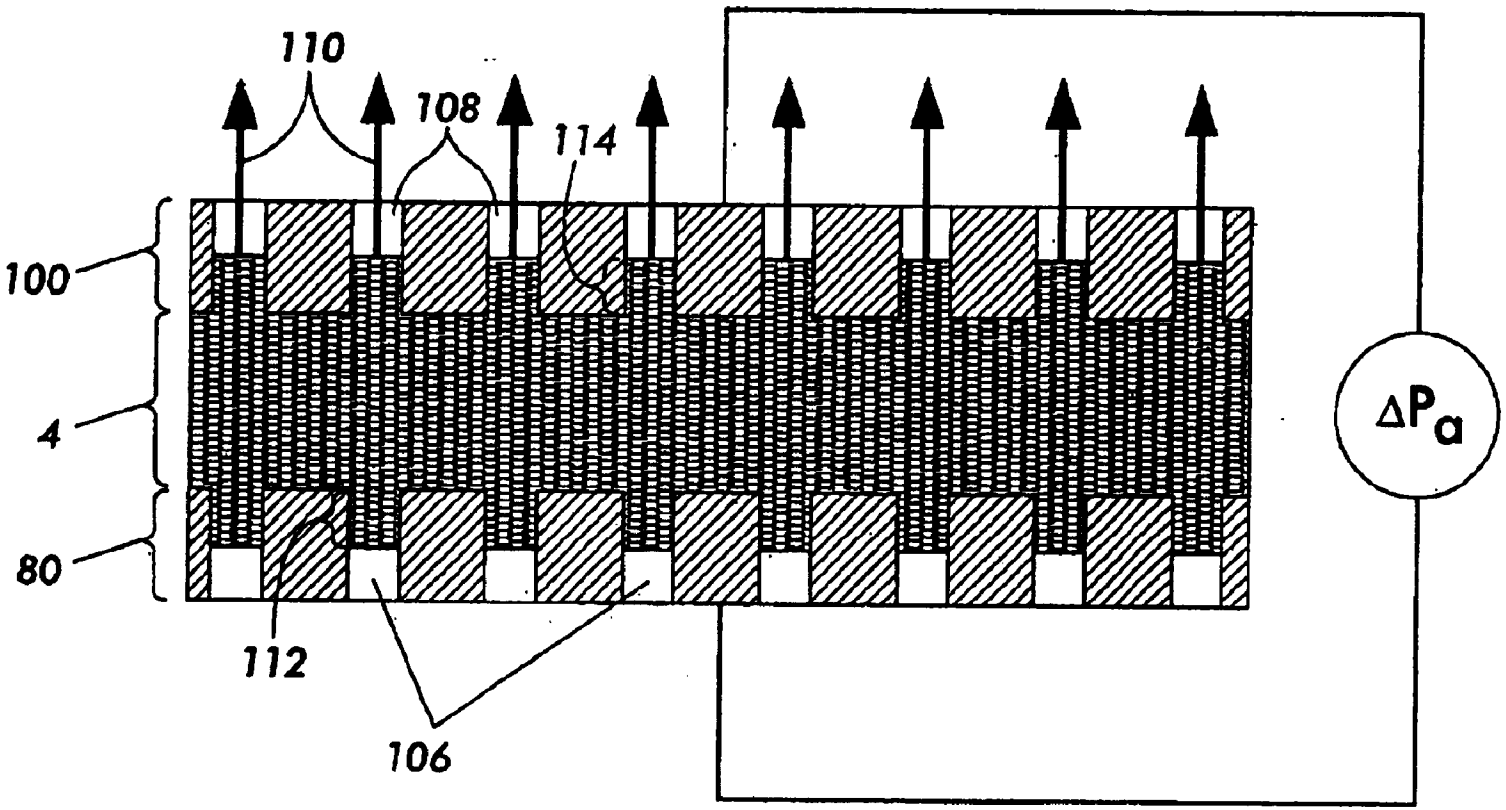
FIG. 4 shows a schematic model of the developed image of FIG. 3 sandwiched between the imaging belt and the cleaning belt of FIG. 3.

FIG. 4 is a schematic model of developed image 4 (ink layer) sandwiched between image bearing belt 80 and cleaning belt 100, wherein $\Delta P_a$ is the pressure drop across image bearing belt 80, developed image 4 and cleaning belt 100 caused by the jet of fluid from air knife 76 and the vacuum created by vacuum system 90. Image bearing belt 80 and cleaning belt 100 are modeled as having pores 106 and 108, respectively, through which the liquid carrier may flow into and through. As developed image 4 is sandwiched or squeezed between image bearing belt 80 and cleaning belt 100, some of the liquid carrier seeps into pores 106, 108. The air pressure created by high pressure air knife 76 and vacuum system 90 causes carrier liquid to flow out of pores 108, as indicated by arrows 110. The portion of pores 106, 108 in which carrier liquid is present are defined herein as capillaries 112, 114, respectively.

Figure 5:
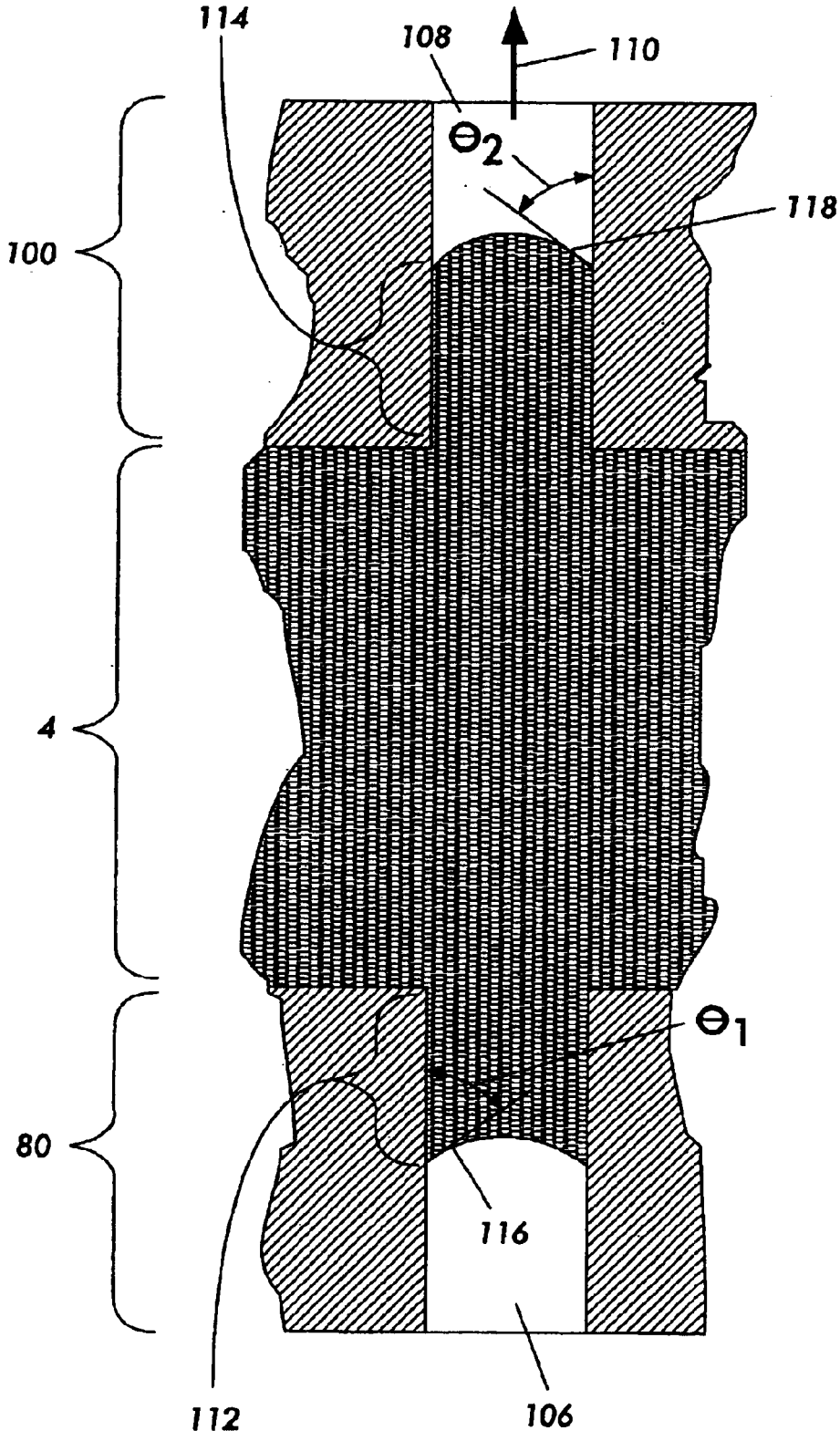
FIG. 5 shows an enlarged view of the model of FIG. 4.

The surface tension of the liquid carrier causes the formation of menisci 116, 118 (FIG. 5) in pores 106 and 108, respectively. The contact angles between each meniscus 116, 118 and the adjacent tube wall are defined herein as $\theta_1$ and $\theta_2$, respectively.

The pressure drop across each meniscus may be determined to be equal to $2\sigma\mathrm{Cos}\theta/r_c$, wherein $\sigma$ is the surface tension of the liquid, and $r_c$ is the radius of the capillary. The pressure drop across developed image 4 may be determined to be equal to $\mu_f v_f R_p$, wherein $\mu_f$ is the dynamic viscosity of the fluid, i.e., of the carrier liquid, $v_f$ is the fluid velocity, and $R_p$ is the blow resistance of the developed image 4. The pressure drop across each capillary may be determined to be equal to $8\mu_f h v_f/(\phi_c r_c^2)$, wherein h is the height of the capillary, and $\phi_c$ is the porosity of the belt. Thus, the pressure drop $\Delta P_a$ across imaging belt 80, developed image 4 and cleaning belt 100 may be determined to be equal to $2\sigma_1\mathrm{Cos}\theta_1/r_{c1}+2\sigma_2\mathrm{Cos}\theta_2/r_{c2}+8\mu_f h_1 v_f/(\phi_{c1} r_{c1}^2)+8\mu_f h_2 v_f/(\phi_{c2} r_{c2}^2)+\mu_f v_f R_p$.

Figure 6:
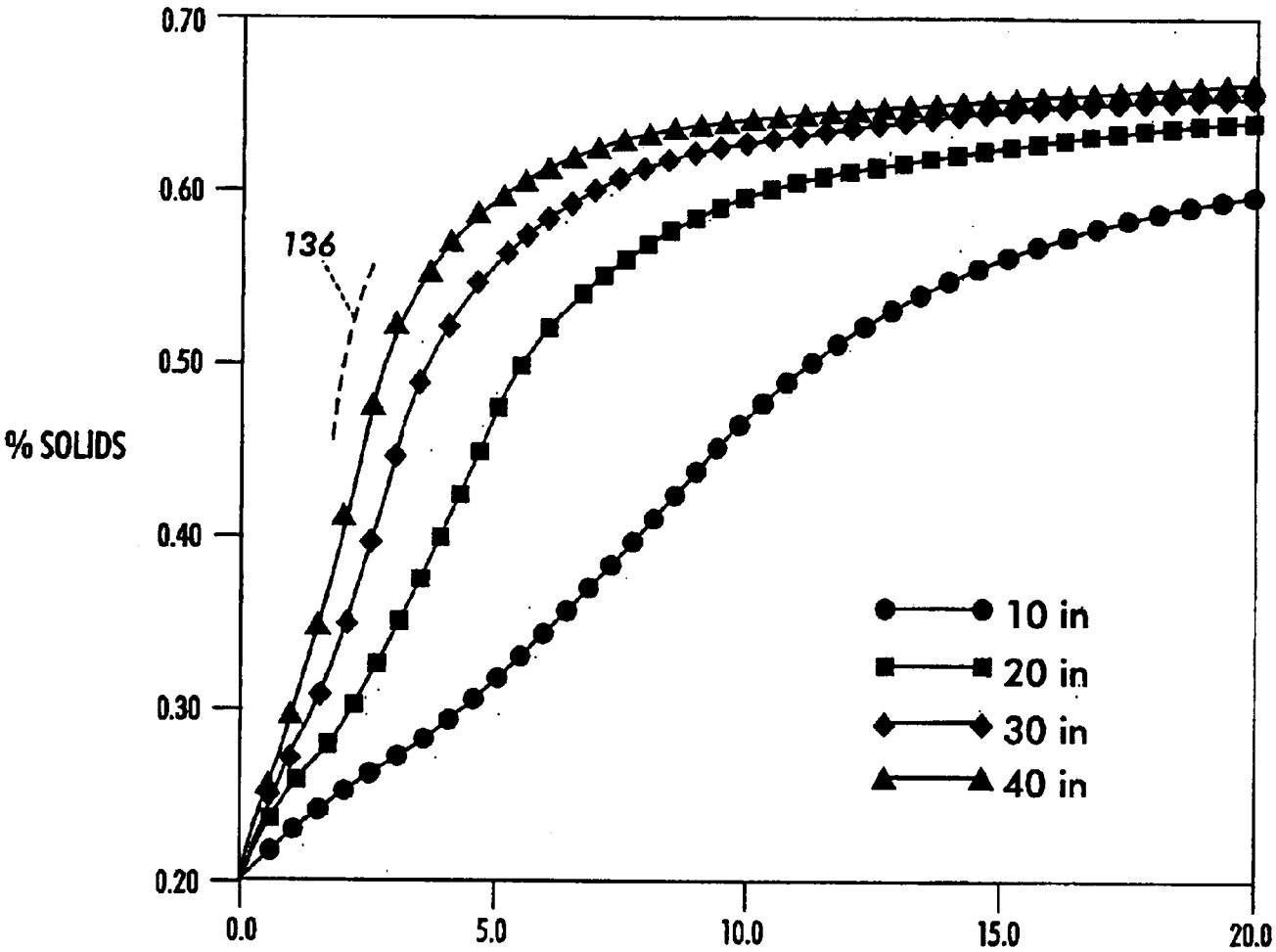
FIG. 6 shows a plot of the solids content percentage of the developed image of FIG. 4 versus time exposed to various levels of air pressure created by the air knife of FIG. 3.
Figure 7:
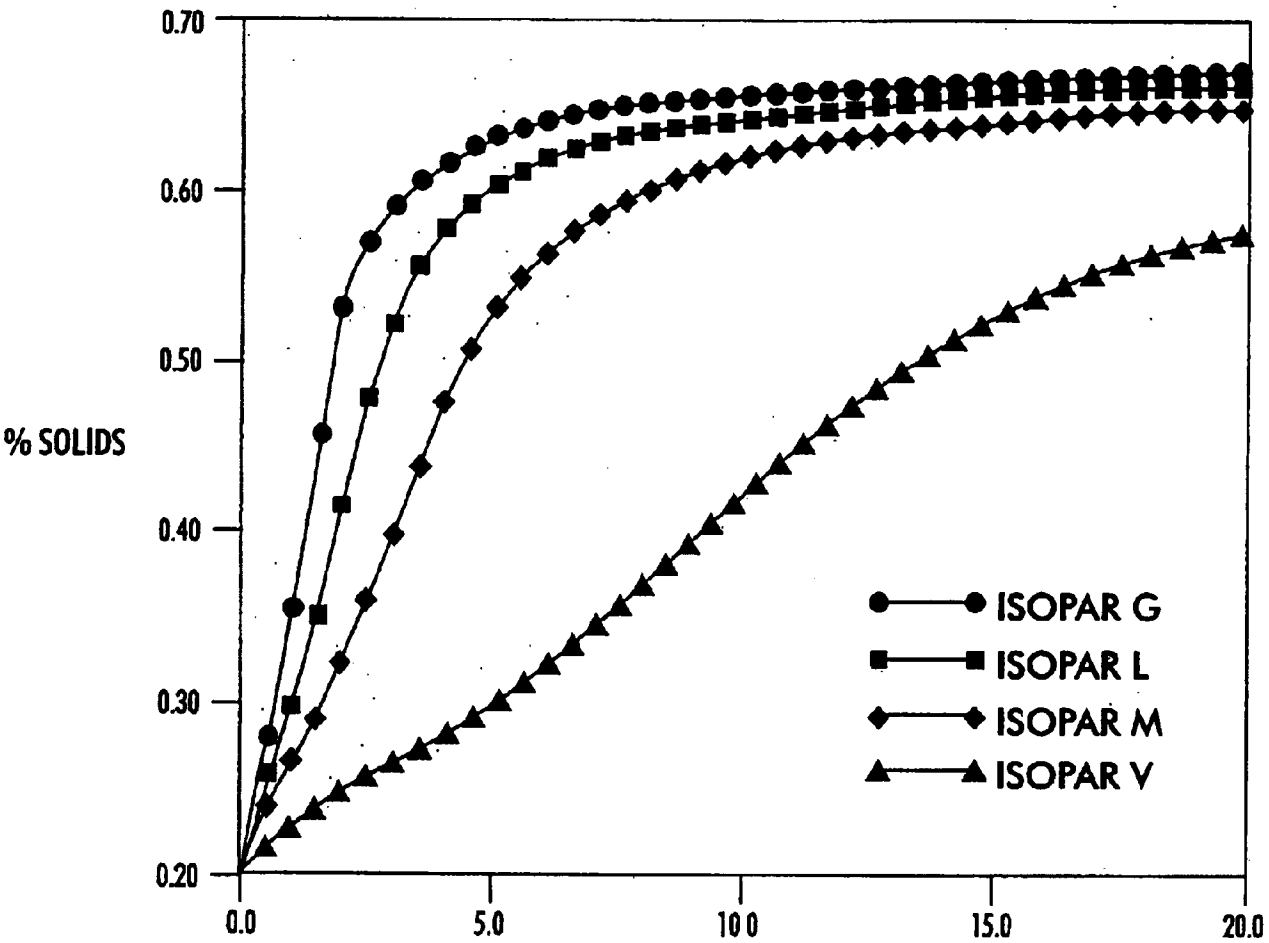
FIG. 7 shows a plot of the solids content percentage of the developed image of FIG. 4 versus time exposed to air pressure created by the air knife and vacuum device of FIG. 3 for various embodiments of the carrier liquid of the developed image of FIG. 4.

The above model may be used to predict the rate of liquid removal from developed image 4. The results are shown in FIGS. 6 and 7. FIG. 6 is a plot of the solids content percentage of developed image 4 as a function of time for four different values of $\Delta P_a$, i.e., 10 inches of water, 20 inches of water, 30 inches of water, and 40 inches of water. The contact angles are assumed to be $\theta=90°$ (non wetting skin). The liquid carrier of FIG. 6 is assumed to be ISOPAR M, an isoparaffinic hydrocarbon available from Exxon Mobil Corporation.

FIG. 7 is a plot of the solids content percentage of developed image 4 as a function of time for four different liquid carriers, i.e., ISOPAR G, ISOPAR L, ISOPAR M AND ISOPAR V, all isoparaffinic hydrocarbons available from Exxon Mobil Corporation. The contact angles are assumed to be $\theta=90°$ (non wetting skin). The pressure $\Delta P_a$ is assumed to be 25 inches of water in FIG. 7.

Figure 8:
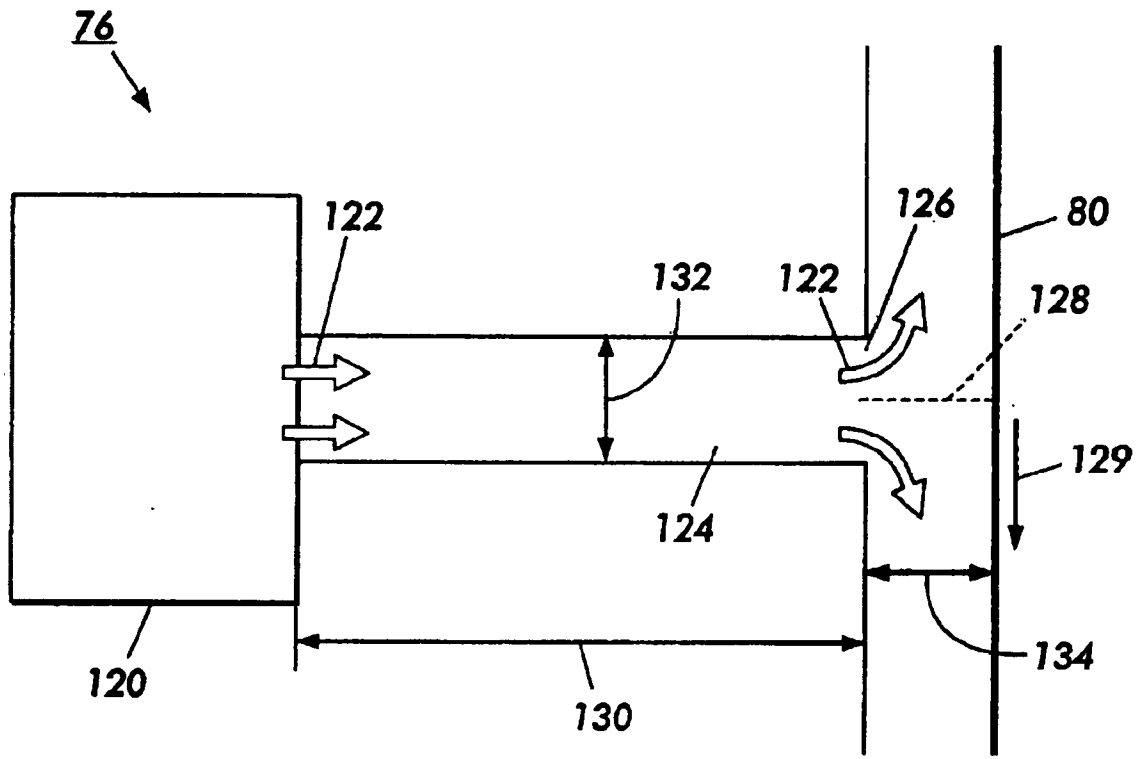
FIG. 8 shows a schematic view of the air knife of FIG. 3 emitting an open-air jet impinging on the imaging belt of FIG. 3.
Figure 9:
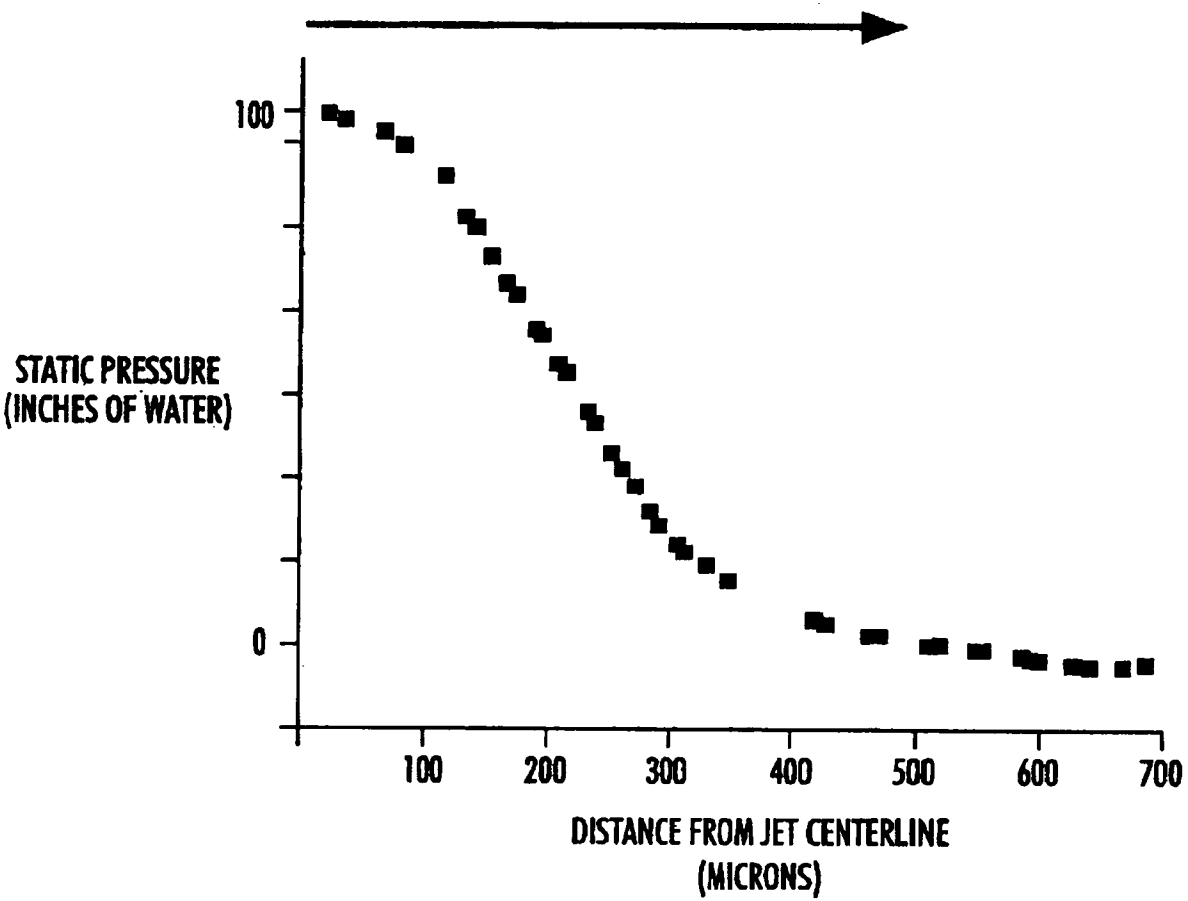
FIG. 9 shows a plot of the static gauge pressure on the imaging belt of FIG. 8 as a function of the distance from the centerline the open-air jet of FIG. 8.

A schematic model of high pressure air knife 76 emitting a jet of air that impinges upon imaging belt 80 is shown in FIG. 8. Air knife 76 includes a high pressure plenum 120 that jets air 122 through a slit 124 and out an exit lip 126 onto imaging belt 80. An air knife that may be used in an embodiment of the present invention is available from Exair, Inc. of Cincinnati, Ohio. The air jet issuing from slit 124 produces a stagnation pressure or static gauge pressure on imaging belt 80 at a jet centerline 128. The pressure attainable on imaging belt 80 may be modeled using a fluid dynamics software program, such as FLUENT, which is available from Fluent, Inc. of Lebanon, N.H. The pressure on imaging belt 80 as a function of the distance in a direction 129 from jet centerline 128 is plotted in FIG. 9 using FLUENT. The plot of FIG. 9 assumes plenum 120 has a pressure of 1.5 atm, slit 124 has a length 130 of 1250 microns and a width 132 of 250 microns, and a gap 134 between exit lip 126 and imaging belt 80 is 500 microns. As may be seen from the plot, the recovered stagnation pressure is 100 inches of water in this model.

From the plots of FIG. 6, one may estimate that a stagnation pressure of 100 inches of water may achieve a solids content of 50% in about 2 milliseconds of dwell time, as indicated by the partially estimated plot 136 for $\Delta P_a$=100 inches of water. Still assuming slit 124 has a width 132 of 250 microns, imaging belt 80 may travel at a process speed of 12.5 cm/second (250 microns/2 msec) and still achieve a solids content of 50%. Process speed may be increased by decreasing gap 134 between exit lip 126 and imaging belt 80.

Figure 10:
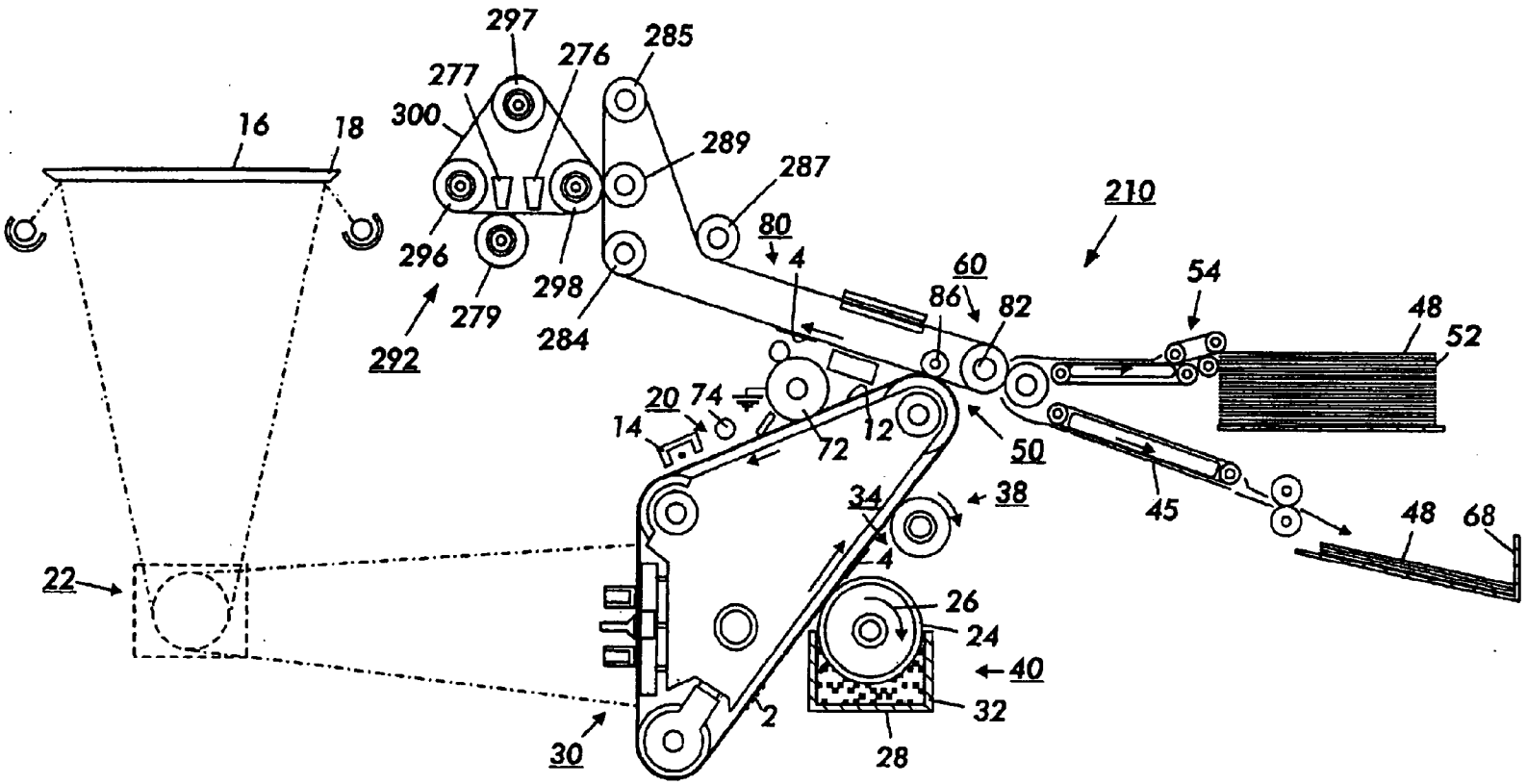
FIG. 10 shows a schematic view of another exemplary electrophotographic machine that includes an arrangement according to embodiments of the subject invention.

Another exemplary embodiment of a reproduction machine 210 of the subject invention is shown in FIG. 10. Reproduction machine 210 includes a high solids conditioning unit (HSIC) 292, carrier rolls 284, 285, 287, and an electrically grounded backing roll 289. Reproduction machine 210 employs a belt 12 having a photoreceptive surface deposited on a conductive substrate. Initially, belt 12 passes through a charging station 20. At the charging station 20, a corona generating device 14 charges the photoreceptive surface of belt 12 to a relatively high, substantially uniform potential.

Once the photoreceptive surface of belt 12 is charged, the charged portion advances to an exposure station 30. An original document 16 which is located upon a transparent support platen 18 is illuminated by an illumination assembly, indicated generally by the reference numeral 22, to generate a light image of document 16. The image rays of the light image correspond to the document information areas and are projected by an optical system of assembly 22 onto the charged portion of the photoconductive surface. The light image dissipates the charge in selected areas to form an electrostatic latent image 2 on the photoreceptive surface that corresponds to the original document informational areas.

Printing machine 210 is disclosed herein as including an analog imaging system. However, it is to be understood that the present invention can also be used in conjunction with a digital imaging system.

After electrostatic latent image 2 has been formed, belt 12 advances electrostatic latent image 2 to a development station 40. At the development station 40, a roller 24, rotating in the direction of arrow 26, brings liquid developer material 28, which includes toner particles dispersed substantially throughout a carrier fluid, from the chamber of housing 32 to a development zone 34. The toner particles pass by electrophoresis to the electrostatic latent image 2. The charge of the toner particles may be opposite in polarity to the charge on the photoreceptive surface when a CAD system, or "write white" system, is used. Thus, the toner particles are attracted to the charged areas of the latent image. Alternatively, the charge of the toner particles may be identical in polarity to the charge on the photoreceptive surface in the case of a DAD system, or "write black" system. In a DAD system, toner is repelled from the charged areas and developed on the discharged areas.

Development station 40 includes a Low Solids Image Conditioner (LSIC) 38. The LSIC 38 encounters developed image 4 on belt 12 and conditions developed image 4 by removing and reducing the liquid content of the developed image 4, while inhibiting and preventing the removal of solid toner particles. LSIC 38 also conditions the image by electrostatically compacting the toner particles of the image. Thus, an increase in percent solids is achieved in the developed image, thereby improving the quality of the final image.

At transfer station 50, developed liquid image 4 is electrostatically transferred to an intermediate member in the form of a nonporous imaging belt indicated by a reference numeral 80. Intermediate belt 80 is entrained about spaced rollers 82, 284, 285, and 287. A bias transfer roller 86 imposes the intermediate belt 80 against the belt 12 to assure image transfer to the intermediate belt 80.

Developed image 4 is brought in contact with a High Solid Image Conditioning (HSIC) unit 292, which further increases the solid particle content of a contacting image. HSIC unit 292 includes a source of high fluid pressure in the form of a high pressure air knife 276, an open-pore, endless loop blotter belt 300 that is carried by carrier rolls 296, 297, 298, and a toner cleaning system. The toner cleaning system is comprised of a fluid applicator 277 and a foam cleaning element or roll 279. In general, HSIC 292 mechanically compresses developed image 4 on transfuse imaging belt 80 between rolls 289, 298, and blots the excess carrier liquid into porous foam blotter belt 300. The cleaning system including applicator 277 and roll 279 removes contaminating toner particles from blotter belt 300 that have been inadvertently transferred or offset from developed image 4 to blotter belt 300. Air knife 276 directs a jet of fluid against blotting belt 300 to remove carrier liquid from blotting belt 300.

In order to inhibit toner particles from being transferred from developed image 4 to blotter belt 300, the toner particles and blotter belt 300 are biased or charged to a same polarity, thereby causing the toner particles to be repelled by the blotter belt 300. More specifically, a voltage source or charging device in the form of a corona generating device 302 (FIG. 11) applies a positive charge to both belt 80 and developed image 4 to charge the toner particles, but not the liquid carrier, of developed image 4. Another charging device in the form of a battery 304 applies a positive charge to carrier roll 298. Thus, the positively charged toner particles in the developed image 4 are repelled by the positively charged carrier roll 298, thereby preventing toner particles from the developed image 4 from contaminating the blotter belt 300. However, the bias voltage applied to carrier roll 298 does not affect the movement of the neutrally charged, dielectric carrier liquid.

As developed image 4 on imaging belt 80 enters the nip between backing roll 289 and carrier roll 298, foam blotter belt 300 contacts image 4. Backing roll 289 and carrier roll 298 apply pressure and compact image 4 to squeeze at least a portion of the liquid carrier out of image 4. Blotter belt 300 absorbs or blots the carrier liquid as it is squeezed out of imaging belt 80 and image 4.

Fluid applicator 277 faces inner surface 306 of blotter belt 300 and emits a jet of a fluid thereon. The fluid emitted by applicator 277 may be the same liquid that is used as the carrier liquid in developed image 4 or another liquid such as water. The fluid jet from applicator 277 pushes the offset toner particles through blotter belt 300 to outer surface 308 of blotter belt 300 opposite from inner surface 306. Foam cleaning roll 279 rotates in the direction indicated by arrow 310 to wipe the toner particles off of outer surface 308. A portion of the outer surface of cleaning roll 279 that is away from belt 300 may be immersed in a liquid bath (not shown) in order to dissolve or otherwise remove the toner particles from cleaning roll 279.

Figure 11:
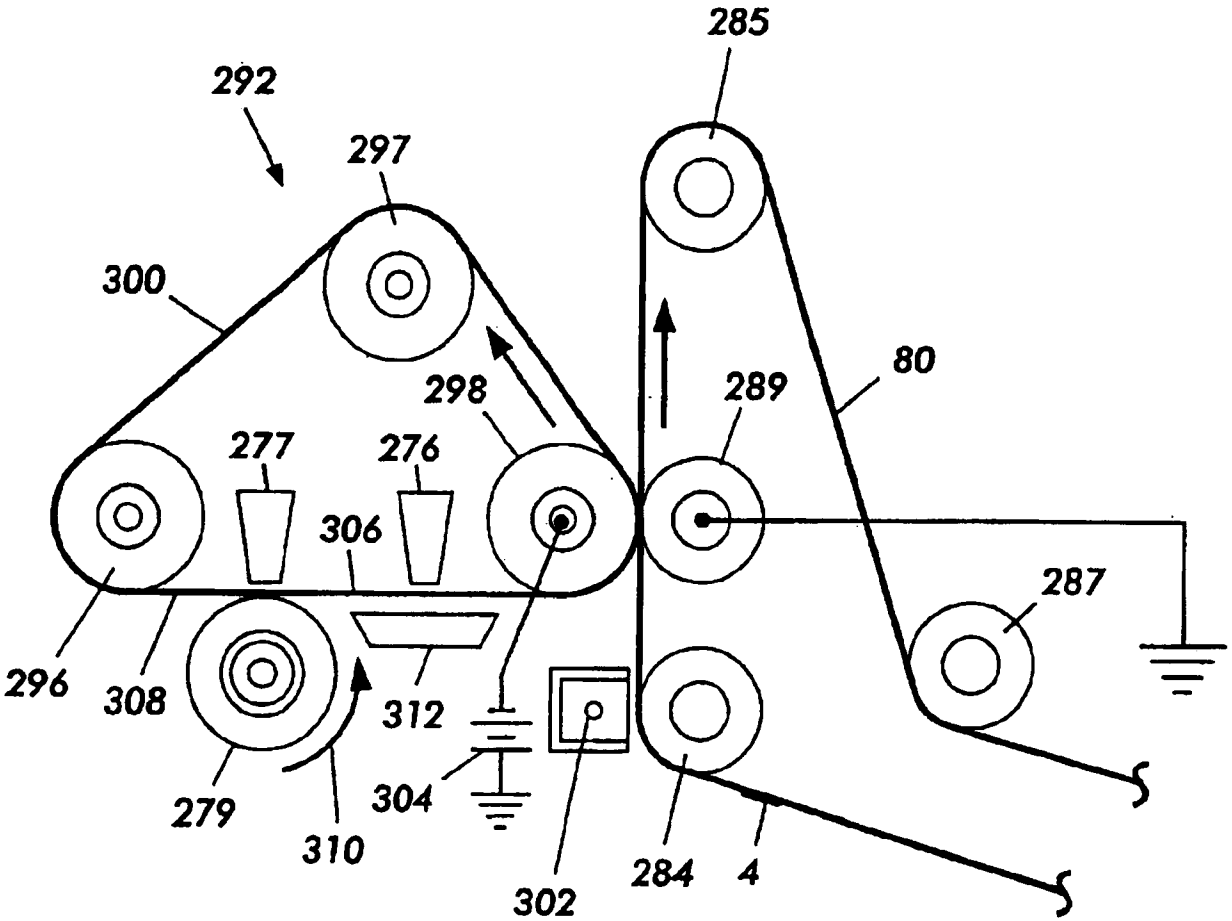
FIG. 11 shows an enlarged view of the HSIC unit of the electrophotographic machine of FIG. 10.

Air knife 276, which is disposed within blotter belt 300, removes the carrier fluid from blotter belt 300, thereby enabling the carrier fluid to be transported out of reproduction machine 210 for recycling or for collection and removal. More specifically, air knife 276 emits a jet of fluid, such as air, directly onto blotter belt 300, thereby causing carrier fluid to be blown out of belt 300 and into a container 312. Thus, air knife 276 indirectly removes at least a portion of the carrier liquid from developed image 4 on image bearing belt 80. The cleaning system of applicator 277 and roll 279 effectively removes toner particles from belt 300, but leaves the carrier liquid from applicator 277 in the belt 300. Subsequently, air knife 276 removes the carrier liquid to restore the carrier liquid absorbing properties of blotter belt 300. While the apparatus shown in FIG. 11 shows only a single air knife 276, multiple air knives may be used in conjunction with a single blotter belt to remove carrier liquid. The forced air from an air knife has been found to be much more effective than a vacuum in removing liquid from a blotter device. Of course, air knife 276 may be located to remove liquid carrier from belt 300 before the toner particles are cleaned from belt 300 by the cleaning system.

Since removal of the carrier liquid is performed by use of an air knife instead of by squeezing, the material of blotter belt 300 may be either compressible or incompressible. This allows the usage of materials having very small pores, such as Permair material made by Porvair, PLC of Norfolk, United Kingdom. The small pores in such a material provide high capillary pressure and increase the ability of the material to imbibe fluid. Consequently, the mechanical pressure needed to compress the image may be reduced or eliminated.

The exemplary systems discussed above may be used to perform the method of the present invention. The method includes transporting a latent image containing liquid carrier and toner particles on a porous substrate and directing a jet of fluid against the latent image to blow liquid carrier from the porous substrate. The method may also include providing a vacuum proximate a surface of the porous substrate to remove liquid carrier blown from the substrate. In an alternative method of the present invention, the method includes applying fluid pressure against a portion of a blotting belt to remove liquid carrier from the blotting belt and contacting a latent image being carried by a substrate with the portion of the blotting belt from which the fluid pressure removed liquid carrier. This alternative method may further include cleaning the blotting belt with liquid to remove toner particles before fluid pressure is used to remove carrier liquid from the blotting belt.

It is, therefore, apparent that there has been provided in accordance with the present invention, an apparatus for increasing the solids content of a developed liquid image that fully satisfies the aims and advantages hereinbefore set forth. While this invention has been described in conjunction with specific embodiments thereof, it is evident that many alternatives, modifications, and variations will be apparent to those skilled in the art. Accordingly, the subject invention is intended to embrace all such alternatives, modifications and variations that fall within the spirit and broad scope of the appended claims.

What is claimed is:

1. A system comprising:

at least one movable image bearing member configured to transport a latent image in an electrophotographic printing system;

a developer station associated with said at least one image bearing member, said developer station being configured to deposit a developed image on the latent image, the developed image including toner particles and carrier liquid;

a transfer station associated with said at least one image bearing member, said transfer station being configured to transfer the developed image to a receiving medium; and a liquid removal station disposed between said developer station and said transfer station, said liquid removal station including a source of high fluid pressure configured to emit a jet of fluid for one of directly and indirectly removing at least a portion of the carrier liquid from the developed image, wherein said at least one image bearing member includes a porous imaging belt, said source of high fluid pressure being configured to emit the jet of fluid directly onto said imaging belt, and wherein said source of high fluid pressure includes an exit lip, a distance between said exit lip and said imaging belt being approximately between 250 microns and 2000 microns.

2. A system comprising:

at least one movable image bearing member configured to transport a latent image in an electrophotographic printing system;

a developer station associated with said at least one image bearing member, said developer station being configured to deposit a developed image on the latent image, the developed image including toner particles and carrier liquid;

a transfer station associated with said at least one image bearing member, said transfer station being configured to transfer the developed image to a receiving medium; and a liquid removal station disposed between said developer station and said transfer station, said liquid removal station including a source of high fluid pressure configured to emit a jet of fluid for one of directly and indirectly removing at least a portion of the carrier liquid from the developed image, wherein said liquid removal station includes a blotter belt contacting the at least one image bearing member, said blotter belt being configured to blot at least some of the carrier liquid from the developed image.

3. The system of claim 2 wherein said source of high fluid pressure comprises an air knife.

4. The system of claim 2 wherein said source of high fluid pressure is configured to emit the jet of fluid onto said blotter belt to blow at least some of the carrier liquid out of said blotter belt and thereby indirectly remove said portion of the carrier liquid from the developed image.

5. A printing machine comprising:

an image bearing member configured to carry a developed image including toner particles and carrier liquid;

a blotter belt contacting the image bearing member, said blotter belt being configured to blot at least a portion of the carrier liquid from the developed image;

a source of high fluid pressure associated with said blotter belt, said source of high fluid pressure being configured to emit a jet of a first fluid for removing at least some of the carrier liquid from the blotter belt, and a cleaning system configured to remove contaminating ones of said toner particles from said blotter belt before said source of high pressure fluid removes the liquid from said blotter belt.

6. The machine of claim 5 wherein said blotter belt forms an endless loop, said machine further comprising a first roll and a second roll, each of said first roll and said second roll carrying said blotter belt, said source of high fluid pressure being disposed within said blotter belt.

7. The machine of claim 6 wherein said first roll supports said blotter belt against said image bearing member, said machine further comprising:

a first charging device configured to charge the toner particles on said image bearing member; and a second charging device configured to charge at least one of said blotter belt and said first roll such that said at least one of said blotter belt and said first roll has a same polarity as said charged toner particles.

8. The machine of claim 5 wherein said source of high fluid pressure comprises a pressurized air knife configured to blow at least some of the carrier fluid out of said blotter belt.

9. The machine of claim 5, wherein said cleaning system includes a fluid applicator configured to emit a jet of a second fluid onto said blotter belt to thereby push the contaminating toner particles to a first surface of said blotter belt, said first surface being opposite from a second surface of said blotter belt, said second surface facing said fluid applicator.

10. The machine of claim 9 wherein said cleaning system includes a cleaning element contacting said first surface of said blotter belt, said cleaning element being configured to remove the contaminating toner particles from said first surface of said blotter belt.

11. A method comprising:

transporting a developed image including toner particles and carrier liquid on an image bearing member located within an electrophotographic machine;

applying a jet of fluid against the image bearing member to remove a portion of the carrier liquid from the image bearing member;

supporting said image bearing member against the jet of fluid; and disposing a cleaning belt between said image bearing member and a backing roll for supporting said image bearing member to prevent the toner particles from contacting said backing roll.

12. The method of claim 11 further comprising:

collecting the carrier liquid removed from the imaging belt by the applied jet of fluid.

13. A method comprising:

transporting a developed image including toner particles and carrier liquid on an image bearing member located within an electrophotographic machine;

applying a jet of fluid against the image bearing member to remove a portion of the carrier liquid from the image bearing member;

supporting said image bearing member against the jet of fluid;

charging the toner particles in the developed image; and charging a backing roll to the same polarity as said charged toner particles so the toner particles are repelled by the backing roll as the carrier liquid is removed by the applied jet of fluid.

14. The method of claim 13 wherein the jet of fluid is applied by a high pressure air knife.

15. The method of claim 13 further comprising:

applying a vacuum to collect carrier fluid removed by the applied jet of fluid.

* * * * *